United States Patent [19]

Credle, Jr.

[11] Patent Number: 4,615,466

[45] Date of Patent: Oct. 7, 1986

[54] BEVERAGE DISPENSER SYSTEM CONVERTABLE BETWEEN GRAVITY AND PRESSURE

[75] Inventor: William S. Credle, Jr., Stone Mountain, Ga.

[73] Assignee: The Coca-Cola Company, Atlanta, Ga.

[21] Appl. No.: 583,537

[22] Filed: Feb. 24, 1984

[51] Int. Cl.[4] ..... B67D 5/56

[52] U.S. Cl. ..... 222/129.1; 222/146.6; 222/148; 62/393; 137/240

[58] Field of Search ..... 222/1, 148, 129, 129.1, 222/129.2, 129.3, 146.1, 146.6; 137/240; 62/390–394, 396; 285/157, 124–126, 131, 132, 137 R

[56] References Cited

U.S. PATENT DOCUMENTS

| | | | |
|---|---|---|---|
| 3,389,716 | 6/1968 | Wilburn | 137/240 |
| 3,460,713 | 8/1969 | Cornelius | 222/146.1 X |
| 3,503,540 | 3/1970 | Fuerst | 222/129.1 |
| 3,800,826 | 4/1974 | McCann | 222/129.1 X |
| 3,902,636 | 9/1975 | Zilk | 222/129.1 |
| 4,008,832 | 2/1977 | Rodth | 222/129.1 |
| 4,406,382 | 9/1983 | Roth | 222/23 X |

*Primary Examiner*—Joseph J. Rolla
*Assistant Examiner*—Kevin P. Shaver

[57] ABSTRACT

A counter electric beverage dispenser a plurality of dispensing valves and a manifold, a syrup cooling tube, and a water cooling tube for each valve. A gravity syrup tank is used during gravity operation and a syrup line from a pressure source is used during pressure operation. One or more of the dispensing valves can be converted from gravity to pressure operation and vice versa. The manifold includes a water passageway therethrough and first and second syrup passageways therethrough. The manifold is connected to the dispensing valve, the water cooling tube and the syrup cooling tube. Either one of a gravity syrup tank or a syrup line from a pressure source can be connected to the manifold for feeding syrup first to the syrup tube and then to the valve. Systems for cleaning out the syrup tubes and for cooling syrup are also included.

38 Claims, 10 Drawing Figures

BEVERAGE DISPENSER SYSTEM CONVERTABLE BETWEEN GRAVITY AND PRESSURE

BACKGROUND OF THE INVENTION

1. Field of the Invention

This invention relates generally to beverage dispensers, and in a preferred embodiment thereof to a counter electric beverage dispenser that is easily convertable from gravity to pressure and vice versa.

2. Description of the Prior Art

Present commercially available beverage dispensers are either gravity dispensers or pressure dispensers. The gravity dispensers employ one or more syrup tanks which are easily filled with syrup as they become empty. Pressure dispensers are fed syrup from pressure systems such as stainless steel syrup tanks (known in this art as figals) pressurized by $CO_2$ and such as bag-in-box systems in which syrup is pumped from a non-pressurized bag to a dispensing valve. These two types of dispensers (i.e. gravity and pressure) employ different dispensing valves.

It is an object of the present invention to provide a beverage dispenser which can be used as either a gravity dispenser or a pressure dispenser, which can be easily converted from one to the other, and in which each valve can be independently set up for either gravity or pressure operation.

It is another object of the invention to provide a system for cleaning out the gravity syrup lines without requiring the usual drain fitting attached to the low point of the gravity syrup lines.

It is another object of the invention to provide a gravity and/or pressure beverage dispenser in which the syrup is cooled as it flows through oversized syrup tubes located in an ice water bath.

It is another object of this invention to provide a beverage dispenser with a manifold which reduces the cost of the syrup cooling tube, which makes it easier to attach the syrup tube to the dispensing valve, which provides a common connection point for both gravity and pressure systems, which supports the syrup tubes thus eliminating expensive tube supports and/or ties, which allows for variations in syrup cooling line lengths, which acts as an insulator to keep syrup cold after it leaves the ice water bath, and which includes screw connections that allow syrup tubes to be replaced with the same size or different size tubes.

SUMMARY OF THE INVENTION

A counter electric beverage dispenser, method and article in which the dispenser includes a syrup compartment liner for holding a plurality of gravity syrup tanks, a plurality of dispensing valves, a plurality of manifolds connected one each to a respective dispensing valve, a plurality of syrup tubes each having an inlet opening and an outlet opening both of which openings are connected to a respective one of the manifolds, a water tube having a plurality of outlet openings connected one each to a respective one of the manifolds, means for cooling the syrup tubes and the water tube, means for individually converting each valve from gravity to pressure operation and vice versa, and means for cleaning out the syrup tubes. Each manifold includes a water passageway therethrough having an inlet port connected to the water tube outlet opening, and an outlet port connected to the water inlet port of a dispensing valve, a first syrup passageway therethrough having an inlet port having a fitting to be attached to a syrup source and an outlet port connected to the syrup tube inlet opening, and a second syrup passageway therethrough having an inlet port connected to the syrup tube outlet opening and an outlet port connected to the syrup inlet port of a dispensing valve. Syrup can be fed to the syrup inlet port of the first syrup passageway of the manifold from either a gravity syrup tank or from a syrup pressure force. The dispenser also includes a $CO_2$ line connected to a T-connector, a $CO_2$ line connected from the T-connector to a built-in carbonator, and a $CO_2$ line connected from the T-connector to a fitting adapted to be connected to the syrup inlet port of the first syrup passageway in the manifold for cleaning out the syrup tube by feeding $CO_2$ therethrough.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 2:
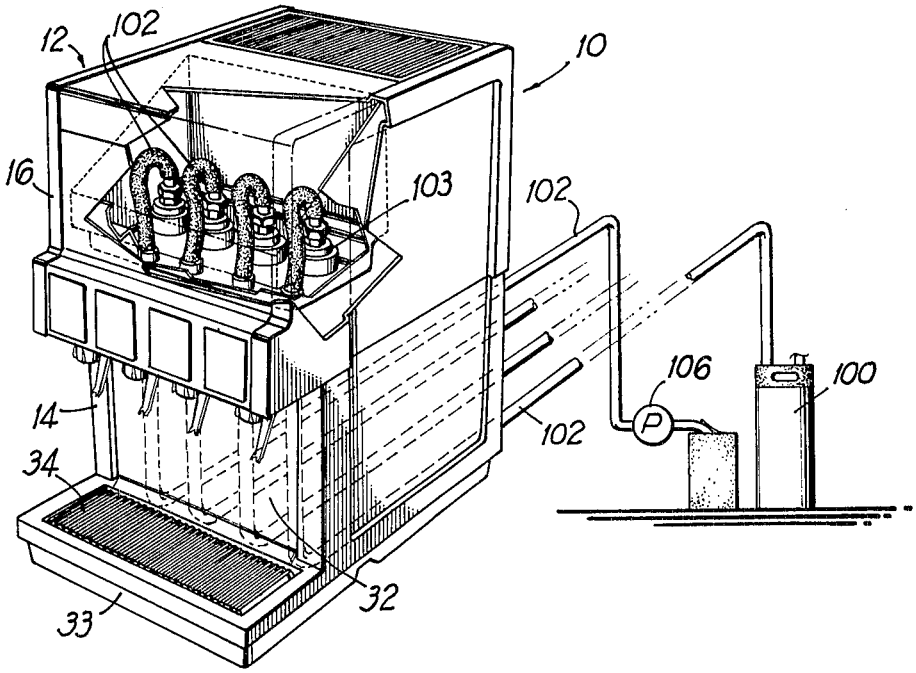
FIG. 2 is a similar perspective view of the dispenser of FIG. 1 but shown converted for use as a pressure dispenser.

With reference now to the drawings, FIGS. 1–10 show a counter electric dispenser 10 according to the present invention. The dispenser 10 includes a housing 12 including a tank 14 and a shroud 16, a mechanical refrigeration system 18 (see FIG. 3), a carbonator 19, a syrup compartment liner 20 for holding four syrup tanks 22, four dispensing valves 24, each one connected to a respective one of four manifolds 26, four syrup cooling tubes 28 and a carbonated water cooling tube 30.

Figure 1:
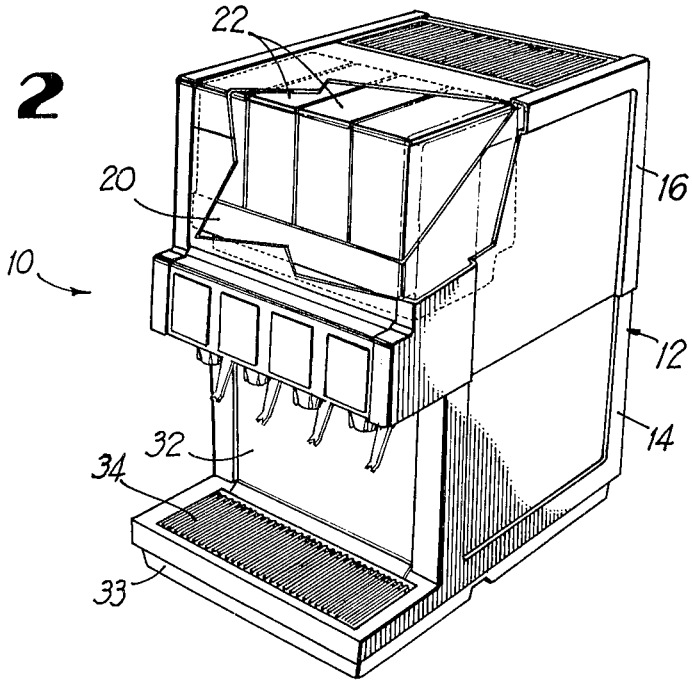
FIG. 1 is a partly broken away, front perspective view of the dispenser of the present invention set up for use as a gravity dispenser.
Figure 3:
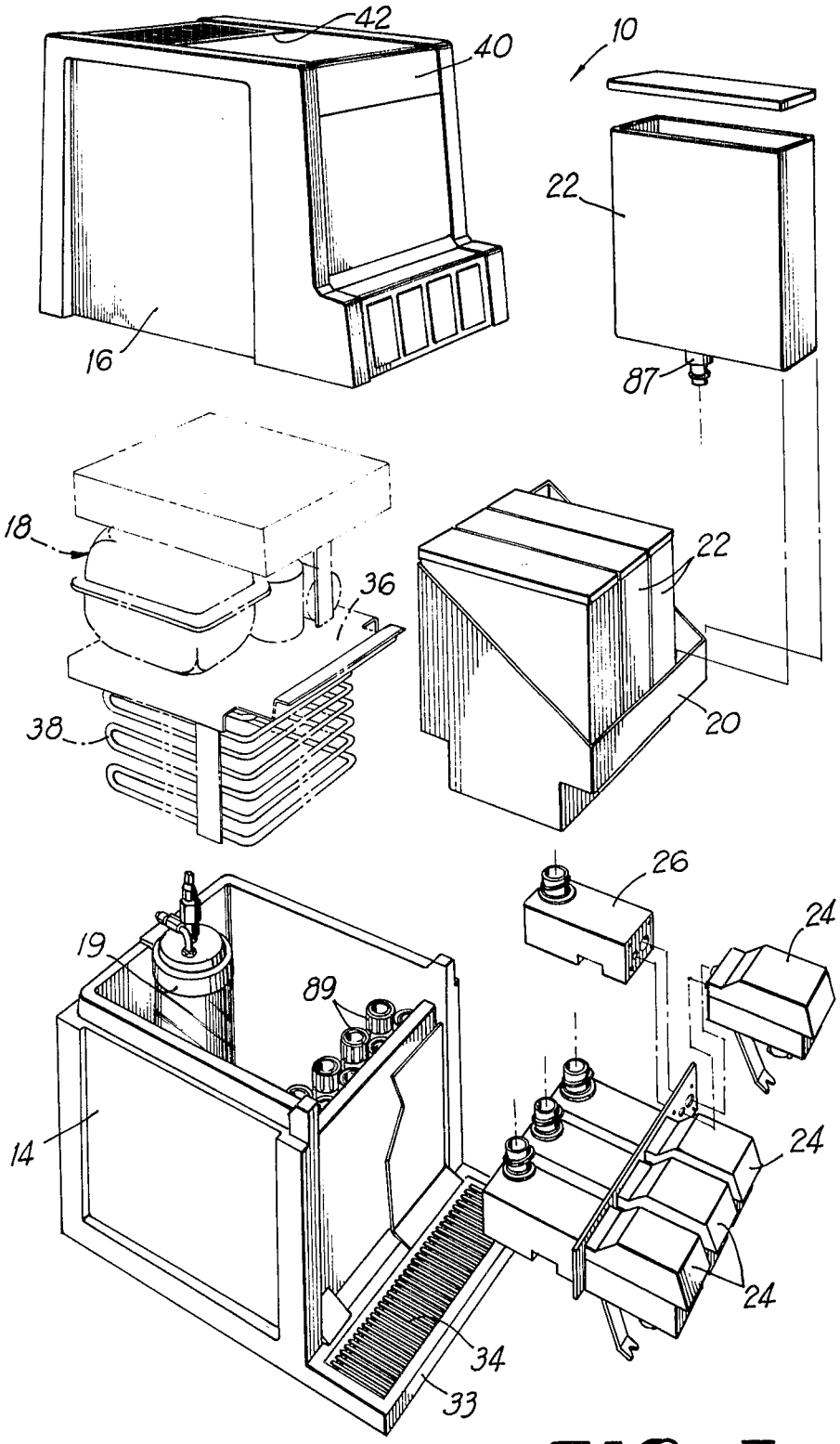
FIG. 3 is an exploded perspective view of the dispenser of FIG. 1.

With reference primarily to FIGS. 1–3, the tank 14 includes a conventional vertical splash plate 32, a drip pan 33, and a cup rest 34 located beneath the valves 24. A conventional refrigeration system can be used including a support plate 36 that rests on top of the tank 14. Cooling coils 38 extend below the plate 36 and produce an ice bank in an ice water bath in the tank 14 to cool the water and syrup in the tubes 28 and 30. Th shroud 16 also rests on top of the tank 14, and includes a top cover 40 that is hingedly connected to the remainder of the shroud at 42 to provide access to the syrup tanks 22 when the dispenser is being used as a gravity dispenser. The bottom wall of the syrup compartment liner 20 preferably has a drain port which can be connected by a tube to the drip pan 33.

Figure 7:
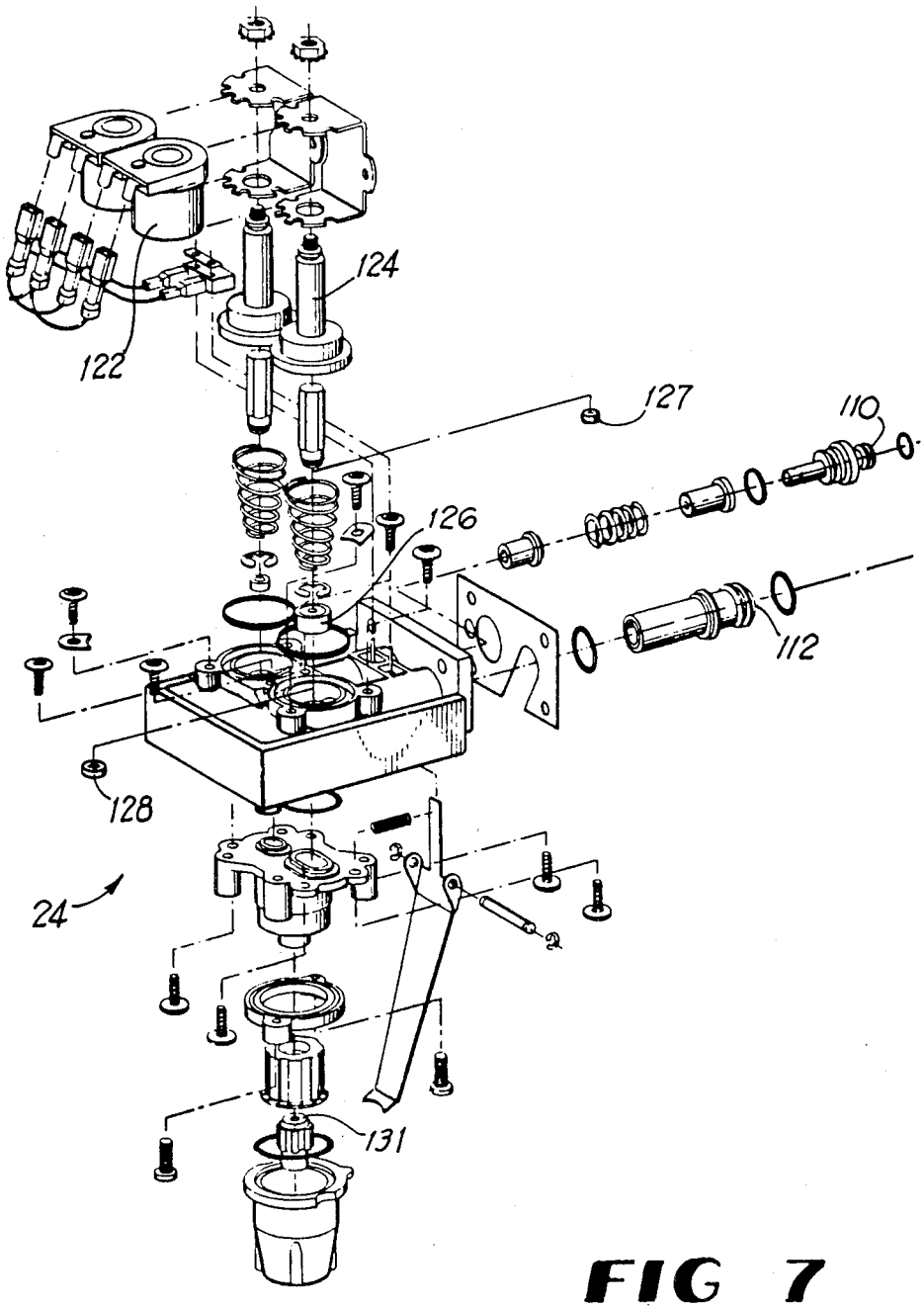
FIG. 7 is an exploded view of a valve used on the dispenser of FIG. 1.

When the dispenser 10 is being used as a gravity dispenser, the valves 24 can be conventional gravity electric valves, such as those sold under the trademark "DOLE SELMIX GEV." This standard valve is shown in FIG. 7 and when it is desired to convert this valve from gravity to pressure operation, this valve can be modified as will be described in detail below.

Figure 8:
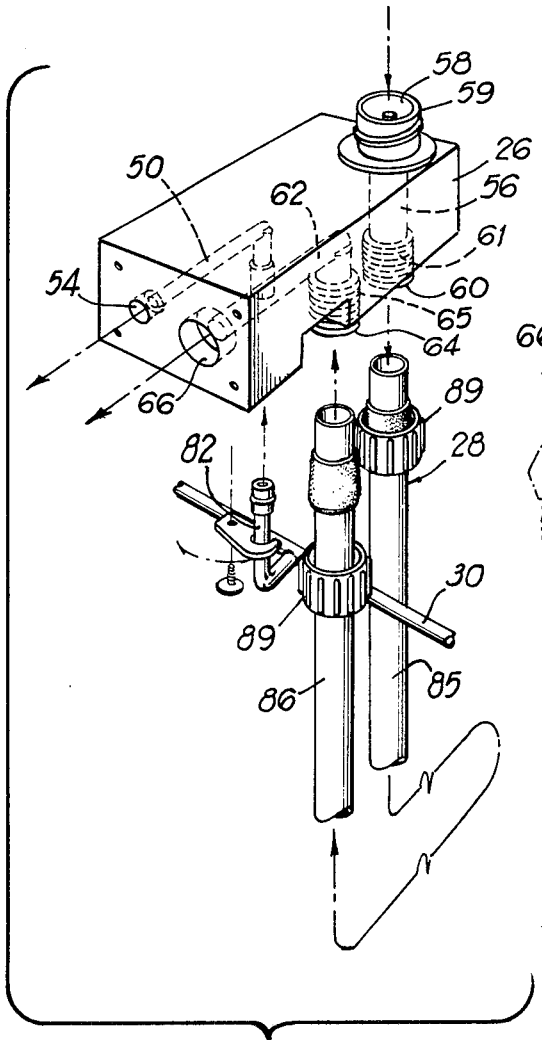
FIG. 8 is a perspective view of the manifold of the present invention.
Figure 10:
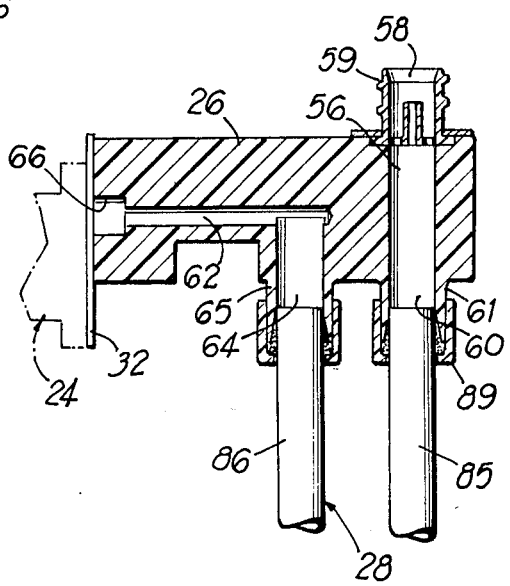
FIG. 10 is a side view of the manifold of FIGS. 8 and 9.
Figure 9:
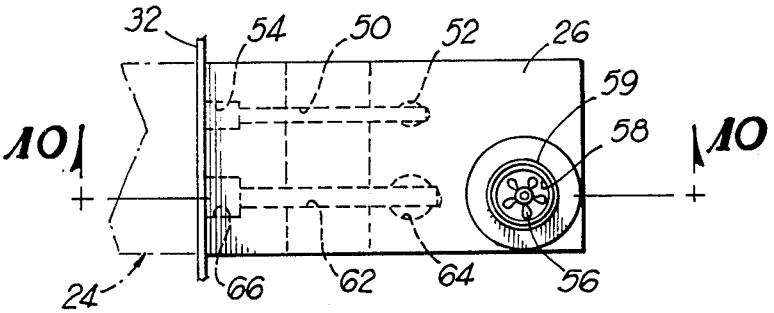
FIG. 9 is a top view of the manifold of FIG. 8.

The manifolds 26 will now be described primarily with reference to FIGS. 4, 5, 6, and 8–10. The manifolds 26 include a groove in their bottom surface that fits onto the top of a front wall 41 of the tank 14; the manifolds 26 are also connected by screws to a mounting plate 32 located above the splash plate 32. The four manifolds 26 are identical to each other, with one manifold being provided for each valve 24. Each manifold 26 is preferably injection molded from a suitable plastic such as "ZYTEL" to provide a one-piece, molded manifold body having molded therein the passageways and ports described below. Alternatively, the manifold can be made of a block of material, such as "DELRIN" with the passageways machined therein. With reference to FIGS. 8, 9 and 10, each manifold 26 includes: (1) a water passageway 50 having an inlet port 52 and an outlet port 54 for connection to a water inlet fitting 110 (see FIG. 7) of the valve 24; (2) a first syrup passageway 56 having an inlet port 58 in an extension 59 and an outlet port 60 in an extension 61 and (3) a second syrup passageway 62 having an inlet port 64 in an extension 65 and an outlet port 66 for connection to a syrup inlet fitting 112 of the valve 24. When the dispenser 10 is operated in its gravity mode (see FIG. 1), a syrup tank 22 is in fluid communication with the inlet port 58.

The manifold 26 is connected to a syrup tube 28 such that the extensions 61 and 65 sealingly engage the inlet opening and the outlet opening of the vertical legs 85 and 86, respectively, of the syrup tube 28. The manifold 26 is also connected to the water tube 30 such that the end of a water tube 82, an o-ring 83, sealingly engages inside of the water inlet port 52 on the manifold 26. The syrup tanks 22 each have an extension 87 with an o-ring, which extension 87 sealingly extends into the syrup inlet port 58 in the extension 59.

The syrup tubes 28 each include two upstanding leg portions 85 and 86 connected at the bottom by a loop portion 88 that is adjacent to the bottom of the tank 14. The tubes 28 are each connected to the manifold 26 by screw threaded connectors 89.

When converting from gravity operation (FIG. 4) to pressure operation (FIG. 5), the syrup tank 22 is lifted off of the extension 59 and a syrup line 102 is fed into the dispenser 10 and through an opening 105 in the bottom of the syrup compartment liner 20. A fitting 103 is connected to the end of the syrup line 102 and is then connected to the extension 59 of the manifold. Syrup is then supplied to the inlet leg 85 of the syrup tube 28 from a pressure source, such as from a figal 100 (see FIG. 2) or from a pump 106 of a bag-in-box system (see FIG. 2).

The syrup tubes 28 have an inside diameter (I.D.) of from about $\frac{5}{8}$ inch to about one and one-fourth inch and preferably have a $\frac{3}{4}$ inch I.D. The syrup tubes 28 can have a wall thickness of about 0.035 inch. This large inside diameter allows the syrup, in the gravity mode, to be able to flow from a tank 22 to a respective valve 24.

Figure 4:
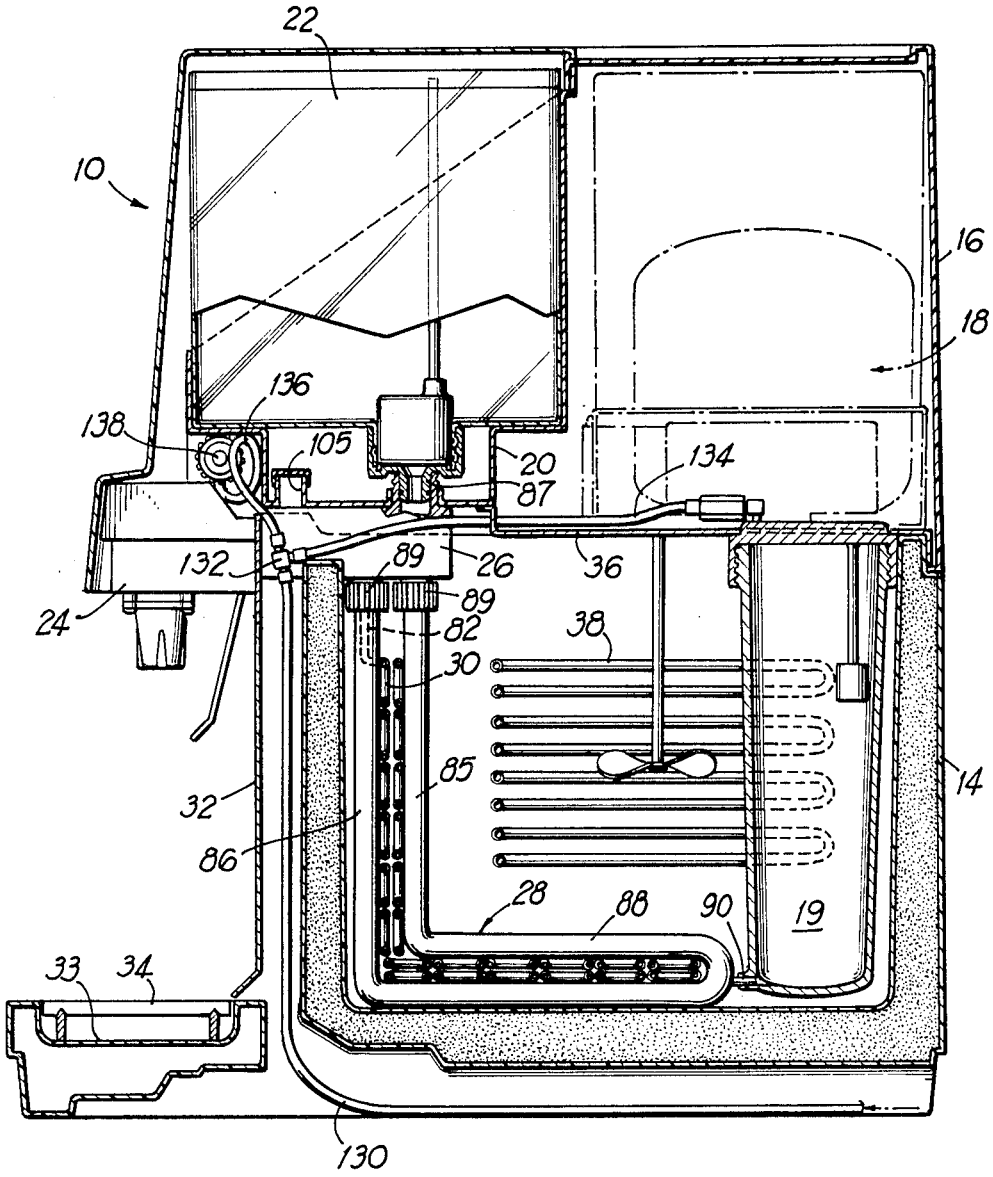
FIG. 4 is a cross-sectional side view of the dispenser of FIG. 1.
Figure 5:
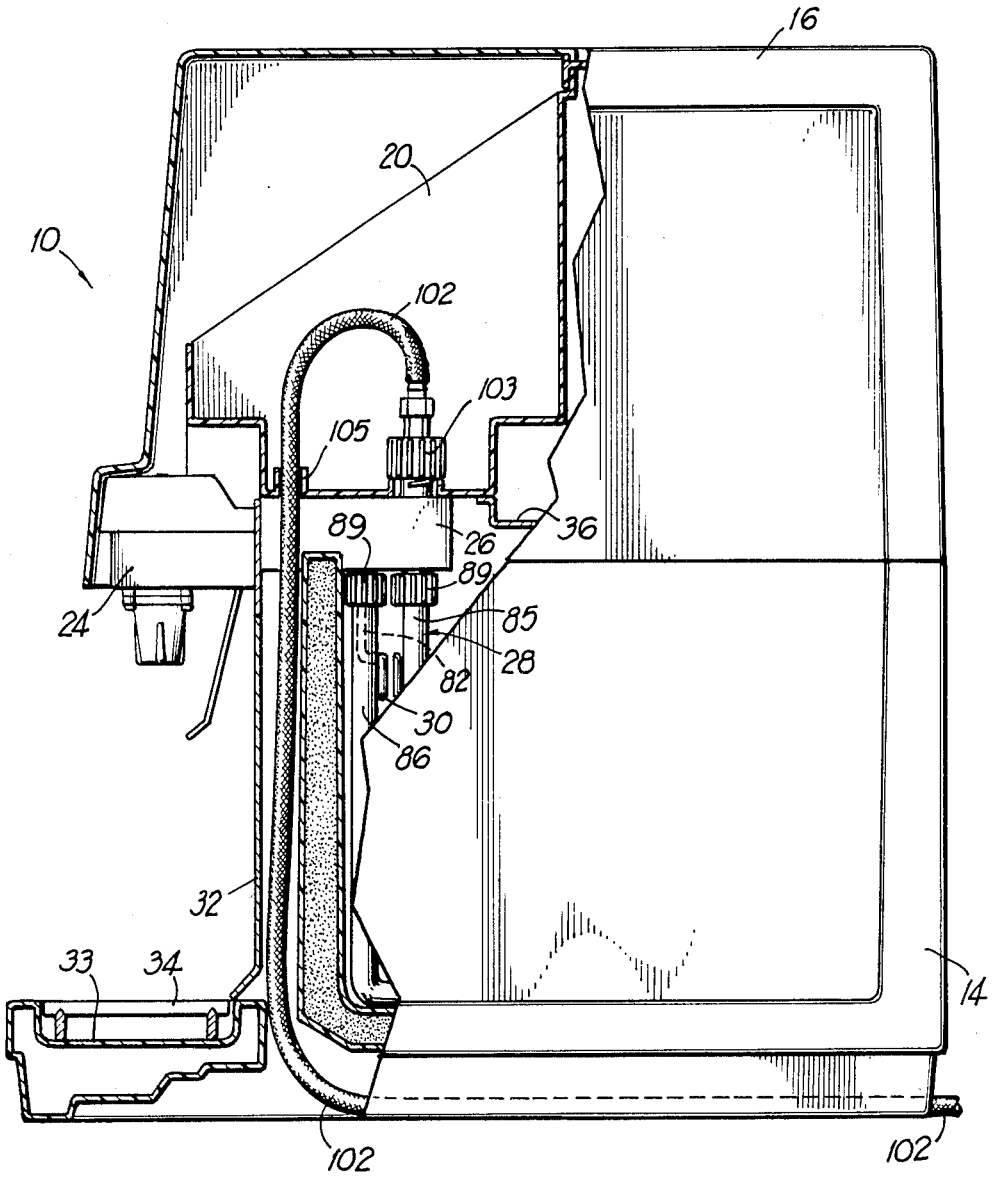
FIG. 5 is a side view partly broken away of the dispenser of FIG. 1.
Figure 6:
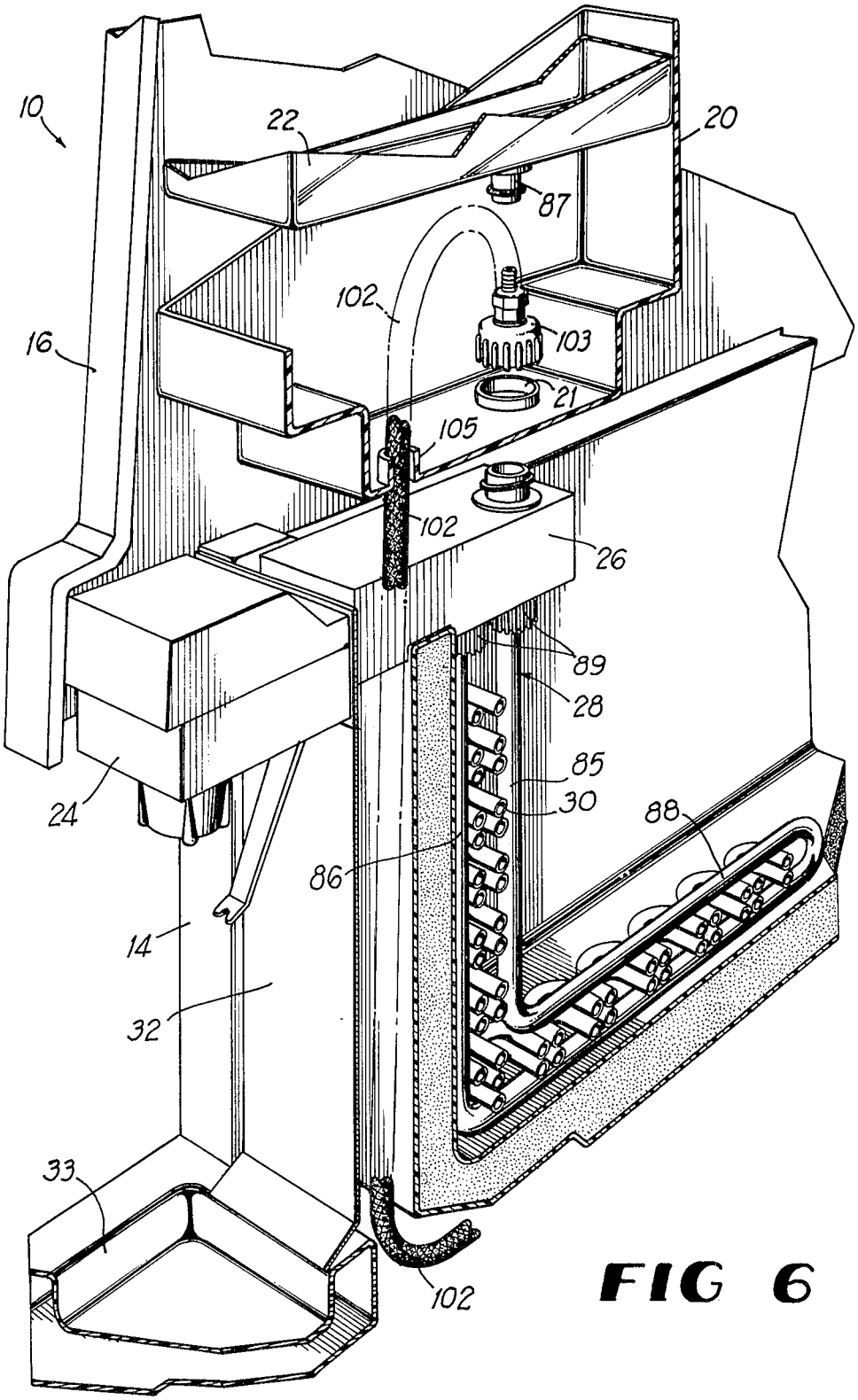
FIG. 6 is a partial, perspective, partly cross-sectional, partly exploded view of the valve and manifold portion of the dispenser of FIG. 1 and showing both a gravity tank and a syrup line, either one of which can be connected to the manifold.

A water cooling tube 30 is preferably provided in the dispenser 10. The tube 30 includes a series of coils and is located as shown in FIG. 4 toward the bottom and front of the tank 14. The tube 30 includes an inlet tube 90 from the carbonator 19. The water tube 30 also includes a closed end outlet tube 94 to which four water tubes 82 are connected, each having a distal end with an o-ring (such as o-ring 83 in FIG. 8) for sealingly connecting to an inlet port 52 of the manifold 26.

FIG. 1 shows the dispenser 10 arranged for use as a gravity dispenser with a syrup compartment liner 20 located above the four manifolds 26 and four syrup tanks 22 positioned in the syrup compartment liner. The liner 20 includes four openings 21 to accommodate the four extensions 59 of the manifolds. Each of the syrup tanks 22 have a conventional float system as used in gravity beverage dispensers. The four syrup tanks 22 are installed with their extensions 87 in sealed communication with a respective inlet port 58.

FIG. 2 shows the dispenser 10 arranged for use solely as a pressure dispenser. It is noted that the syrup tanks 22 are removed. One or more figals 100 can be connected to the dispenser 10 with their syrup lines 102 connected one each to a respective one of the extensions 59. Alternatively, one or more pumps 106 of a bag-in-box system can be connected by the syrup line 102 to the extensions 59. Any combination of gravity tanks, figals and bag-in-box systems can be used.

The manner of converting from gravity to pressure, and vice versa, has already been described above except with respect to the valve 24. While a gravity valve can simply be replaced with a pressure valve and vice versa, it is preferred to retain the valve on the dispenser and to make certain modifications to the valve 24 as set forth below. The following steps are taken to convert each valve 24 from gravity to pressure operation, and include the modification to the valve (see FIG. 7) as well as all other steps: (1) remove the valve cover; (2) remove the syrup solenoid coil 122; (3) remove the armature guide assembly 124 (the metal post and hat); (4) remove the larger rubber armature tip 126 used in gravity operations and replace it with the smaller armature tip 127 used in pressure valves; (5) press a syrup seat 128 having an orifice smaller than that in the gravity valve and the same as that in a pressure valve, into the syrup port (not visible in FIG. 7) of the valve; (6) replace the armature guide assembly and syrup solenoid coil; (7) remove the syrup tank 22; (8) insert a syrup line 102 into the dispenser and connect its connector 103 to the extension 59 of the manifold 26; and (9) remove the dispenser nozzle and remove the syrup shim stock orifice 131 and replace the nozzle to provide a larger opening therethrough.

It will be seen that in order to convert from gravity to pressure, it is preferred to drain the syrup out of the tank 22 to prevent spillage.

Another aspect of this invention is that of cleanout of each of the syrup tubes 28. This is accomplished by connecting a water line or an air line (or any other cleaning fluid) under pressure to each of the extensions 59 and blowing out the respective tubes 28 under pressure. The valve 24 is held open to allow the cleaning fluid and syrup to escape from the tube 28. This procedure is continued until the syrup tube 28 is clean. One example of a system for cleaning out the syrup lines is shown in FIG. 4. In this embodiment, the dispenser 10 includes a $CO_2$ line 130 connected to a T-connector 132.

A $CO_2$ line 134 goes from the T-connector 132 to the carbonator 19. A second $CO_2$ line 136 goes from the T-connector 132 to a fitting 138 which can be stored in any convenient space in the dispenser 10. During clean-out of the syrup tube 28, the tank 22 or the connector 103 of a syrup line 102 is removed from the extension 59 and the fitting 138 is connected to the extension 59. $CO_2$ is then blown through the syrup tube 28 while holding the valve 24 open. The fitting 138 can have a removable cap or it can be spring biased closed with the closure being automatically moved to an open position by a pin in the extension 59 when the fitting 138 is attached thereto. Alternatively, the $CO_2$ line can just go directly to the carbonator and a separate cleaning fluid line can be used.

While the preferred embodiment of this invention has been described above, it is to be understood that variations and modifications can be made therein. For example, while four valves are shown, more or fewer can be used. While one water coil is shown, any number can be used including, for example, a separate one for each valve. A particular valve has been shown, however, other valves can be used and rather than modify the valve to convert between gravity and pressure, the valve can simply be replaced with a different valve. The manifold can be made of other materials, in other ways, and can have other shapes. Instead of having four separate single manifolds, a single manifold body can be molded or otherwise provided that has all of the fluid passageways and ports therein that are contained in the four manifolds shown in the drawings. Also, while the preferred embodiment of the manifold includes a water passageway therethrough, this is not essential; that is, the manifold can have just the syrup passageways therethrough. Other ways of connecting the syrup tubes, the syrup tanks and the syrup lines to the manifold can be used in place of the specific ways shown in the drawings and described above. Other means for cooling the water and syrup can be used in place of the mechanical refrigeration system 18. The dispenser 10 is not limited to use as a counter top dispenser. While the dispenser is shown with a built-in carbonator, this is not essential; a separate carbonator can be used, if desired.

It should thus be apparent that various alterations, modifications, and changes may be made in the preferred embodiment illustrated herein without departing from the spirit and scope of the present invention as defined in the appended claims.

What is claimed is:

1. A beverage dispenser comprising:

(a) a syrup cooling tube having an inlet opening and an outlet opening;

(b) a manifold having a first syrup passageway therethrough having a syrup inlet port and a syrup outlet port, and having a second syrup passageway therethrough having a syrup inlet port and a syrup outlet port;

(c) said syrup cooling tube being connected to said manifold with said syrup cooling tube inlet opening being connected to said syrup outlet port of said first syrup passageway and with said syrup cooling tube outlet opening being connected to said syrup inlet port of said second syrup passageway; and (d) said syrup inlet port of said first group passageway having means for connecting thereto one of a syrup gravity tank or a syrup line.

2. The beverage dispenser as recited in claim 1 including a syrup gravity tank connected to said inlet port of said first syrup passageway.

3. The beverage dispenser as recited in claim 1 including a water cooling tube having an inlet opening and an outlet opening, a dispensing valve having a water inlet port and a syrup inlet port connected to said dispenser, with said valve water inlet port being connected to said water cooling tube and with such valve syrup inlet port being connected to said outlet port of said second syrup passageway.

4. The beverage dispenser as recited in claim 1 including a water cooling tube having an inlet opening and an outlet opening and wherein said manifold includes a water passageway therethrough having a water inlet port and a water outlet port and wherein said outlet opening of said water cooling tube is connected to said manifold water inlet port.

5. The beverage dispenser as recited in claim 1 wherein said dispenser includes a plurality of said manifolds and a plurality of said syrup cooling tubes.

6. The beverage dispenser as recited in claim 1 including a carbonator and including a first $CO_2$ line connected to a T-connector, a second $CO_2$ line connected from said T-connector to said carbonator, and a third $CO_2$ line connected from said T-connector to a fitting adapted to sealing connect to said inlet port of said first syrup passageway of said manifold.

7. The beverage dispenser as recited in claim 1 including means for connecting a fluid syrup cleanout line to said inlet port of said first syrup passageway.

8. The beverage dispenser as recited in claim 1 including a water cooling tube having an inlet opening and an outlet opening and including means for cooling said syrup cooling tube and said water cooling tube.

9. The beverage dispenser as recited in claim 8 wherein said dispenser includes a carbonator and said water cooling tube inlet opening is connected to said carbonator.

10. The beverage dispenser as recited in claim 1 including a syrup line connected at one end thereof to said inlet port of said first syrup passageway.

11. The beverage dispenser as recited in claim 10 wherein the other end of said syrup line is connected to a figal.

12. The beverage dispenser as recited in claim 10 wherein the other end of said syrup line is connected to a pump of a bag-in-box system.

13. The beverage dispenser as recited in claim 1 including a water cooling tube having an inlet opening and an outlet opening and wherein said manifold includes a water passageway therethrough having a water inlet port and a water outlet port, wherein said outlet opening of said water cooling tube is connected to said manifold water inlet port, and including a dispensing valve having a water inlet port and a syrup inlet port connected to said dispenser, with said valve water inlet port being connected to said outlet port of said water passageway and with said valve syrup inlet port being connected to said outlet port of said second syrup passageway.

14. The beverage dispenser as recited in claim 13 including a syrup gravity tank connected to said inlet port of said first syrup passageway.

15. The beverage dispenser as recited in claim 13 including a plurality of said dispensing valves, a plurality of said manifolds and a plurality of said syrup cooling tubes.

16. The beverage dispenser as recited in claim 13 including a syrup line connected at one end thereof to said inlet port of said first syrup passageway.

17. The beverage dispenser as recited in claim 16 wherein the other end of said syrup line is connected to a figal.

18. The beverage dispenser as recited in claim 16 wherein the other end of said syrup line is connected to a pump of a bag-in-box system.

19. A method for converting a beverage dispenser from gravity to pressure operation comprising:

(a) providing a beverage dispenser including a syrup cooling tube having an inlet opening and an outlet opening; a water cooling tube having an inlet opening and an outlet opening; a manifold having a first syrup passageway therethrough having a syrup inlet port and a syrup outlet port and a second syrup passageway therethrough having a syrup inlet port and a syrup outlet port; said syrup cooling tube being connected to said manifold with said syrup cooling tube inlet opening being connected to said syrup outlet port of said first syrup passageway and with said syrup cooling tube outlet opening being connected to said syrup inlet port of said second syrup passageway; and said syrup inlet port of said first syrup passageway having means for connecting thereto one of a syrup gravity tank or a syrup line;

(b) connecting a gravity syrup tank to said syrup inlet port of said first syrup passageway to operate said beverage dispenser as a gravity dispenser; and (c) converting said beverage dispenser from gravity operation to pressure operation by removing said syrup gravity tank from said manifold and connecting one end of a syrup line from a syrup pressure source to said syrup inlet port of said first syrup passageway of said manifold.

20. The method as recited in claim 19 wherein said dispenser includes a dispensing valve having a water inlet port and a syrup inlet port with said valve water inlet port connected to said water cooling tube and with said valve syrup inlet connected to said outlet port of said second syrup passageway, and converting said valve from gravity operation to pressure operation by modifying said valve to reduce the cross-sectional area of the syrup flow passageway therethrough to a smaller area substantially the same as that used in dispensing valves on pressure dispensers.

21. The method as recited in claim 19 wherein the syrup pressure source is a figal and the other end of said syrup line is connected to the figal.

22. The method as recited in claim 19 wherein the syrup pressure source is a pump of a bag-in-box system and is connected to the pump of a bag-in-box system.

23. The method as recited in claim 19 wherein said manifold includes a water passageway therethrough having a water inlet port and a water outlet port.

24. The method as recited in claim 19 including cooling the syrup in said syrup cooling tube by maintaining said syrup tube in an ice water bath and providing said syrup cooling tube with an inner diameter of from about $\frac{5}{8}$ inch to about 1 and $\frac{1}{4}$ inch.

25. The method as recited in claim 19 including cleaning said syrup cooling tube by connecting a cleaning fluid line to said syrup inlet port of said first syrup passageway, and feeding cleaning fluid into and through said syrup cooling tube.

26. The method as recited in claim 25 wherein said dispenser includes a dispensing valve having a water inlet port and a syrup inlet port with said water inlet port connected to said water cooling tube and said syrup inlet port connected to said syrup outlet port of said second syrup passageway, and including holding said valve opening during said feeding of cleaning fluid into and through said syrup cooling tube.

27. A method for cleaning out a syrup tube in a gravity dispenser comprising:

(a) providing a beverage dispenser including a syrup cooling tube having an inlet opening and an outlet opening; a water cooling tube having an inlet opening and an outlet opening; a manifold having a first syrup passageway therethrough having a syrup inlet port and a syrup outlet port and a second syrup passageway therethrough having a syrup inlet port and a syrup outlet port; said syrup cooling tube being connected to said manifold with said syrup cooling tube inlet opening being connected to said syrup outlet port of said first syrup passageway and with said syrup cooling tube outlet opening being connected to said syrup inlet port of said second syrup passageway; and said syrup inlet port of said first syrup passageway having means for connecting thereto one of a syrup gravity tank or a syrup line;

(b) cleaning out said syrup cooling tube by connecting a cleaning fluid line to said syrup inlet port of said first syrup passageway and feeding cleaning fluid into and through said syrup cooling tube and out only through said syrup cooling tube outlet opening.

28. The method as recited in claim 27 wherein said dispenser includes a dispensing valve having a water inlet port and a syrup inlet port with said valve water inlet port connected to said water cooling tube and with said valve syrup inlet connected to said outlet port of said second syrup passageway, and maintaining said dispensing valve open during said feeding of cleaning fluid into and through said syrup cooling tube for feeding cleaning fluid out through said dispensing valve.

29. The method as recited in claim 27 wherein said syrup cooling tube includes a substantially vertical inlet leg and a substantially vertical outlet leg, said legs being connected at their bottoms to a loop portion, and including the step of cooling said syrup cooling tube by maintaining said vertical legs and said loop portion in an ice water bath.

30. A one-piece, molded manifold adapted to be connected to a single beverage dispensing valve comprising:

(a) a manifold body having a first syrup passageway therethrough having a syrup inlet port and a syrup outlet port, a separate second syrup passageway therethrough having a syrup inlet port and a syrup outlet port, and a separate water passageway therethrough having a water inlet port and a water outlet port;

(b) said manifold having a flat, vertical front surface, and said water outlet port and said syrup outlet port of said second syrup passageway being located in said front surface for connection to a single beverage dispenser valve assembly;

(c) said manifold having a flat, horizontal top surface and said syrup inlet port of said first syrup passageway being located in said top surface; and (d) said manifold having a flat, horizontal bottom surface and said syrup outlet port of said first syrup passageway and said syrup inlet port of said second syrup passageway being located in said bottom surface.

31. The manifold as recited in claim 30 including a syrup cooling tube connected between said syrup outlet port of said first syrup passageway and said syrup inlet port of said second syrup passageway.

32. The manifold as recited in claim 27 including a plurality of said manifolds located side-by-side in a beverage dispenser and including a single beverage dispensing valve connected to each of said manifolds.

33. The manifold as recited in claim 30 including a single beverage dispensing valve having a water inlet port and a syrup inlet port, said valve being connected to said manifold with said water outlet port of said manifold connected to said water inlet port of said valve and said syrup outlet port of said second syrup passageway connected to said syrup inlet port of said valve.

34. The manifold as recited in claim 33 including a syrup cooling tube connected between said syrup outlet port of said first syrup passageway and said syrup inlet port of said second syrup passageway.

35. Apparatus for use in a beverage dispenser comprising a one-piece, molded manifold connected to only a single beverage dispensing valve, said manifold comprising a manifold body, said body having a first syrup passageway therethrough having a syrup inlet port and a syrup outlet port, and a separate second syrup passageway therethrough having a syrup inlet port and a syrup outlet port, and said valve having a single syrup inlet port connected to said syrup outlet port of said second syrup passageway.

36. The apparatus as recited in claim 35 including a syrup cooling tube connected between said syrup outlet port of said first syrup passageway and said syrup inlet port of said second syrup passageway.

37. The apparatus as recited in claim 35 including a single water passageway through said manifold having a water inlet port and a water outlet port, and wherein said single beverage dispensing valve has a single water inlet port connected to said water outlet port.

38. The apparatus as recited in claim 37 including a syrup cooling tube connected between said syrup outlet port of said first syrup passageway and said syrup inlet port of said second syrup passageway.

* * * * *